US006758695B2

(12) United States Patent
Pepe et al.

(10) Patent No.: US 6,758,695 B2
(45) Date of Patent: Jul. 6, 2004

(54) CONNECTOR ASSEMBLY WITH A FLOATING SHIELD DIVIDING CONTACTS FORMED IN DIFFERENTIAL PAIRS

(75) Inventors: Paul John Pepe, Winston-Salem, NC (US); Linda Ellen Bert, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 58 days.

(21) Appl. No.: 10/184,776

(22) Filed: Jun. 28, 2002

(65) Prior Publication Data

US 2004/0002261 A1 Jan. 1, 2004

(51) Int. Cl.[7] ..... H01R 13/648
(52) U.S. Cl. ..... 439/608; 439/405; 439/941
(58) Field of Search ..... 439/404, 405, 439/941, 608, 108, 403

(56) References Cited

U.S. PATENT DOCUMENTS

| | | | | |
|---|---|---|---|---|
| 4,099,822 A | * | 7/1978 | Carlisle et al. | 439/405 |
| 4,846,727 A | | 7/1989 | Glover et al. | 439/608 |
| 5,046,960 A | | 9/1991 | Fedder | 439/108 |
| 5,160,273 A | | 11/1992 | Carney | 439/108 |
| 5,549,481 A | | 8/1996 | Morlion et al. | 439/108 |
| 5,730,609 A | | 3/1998 | Harwath | 439/108 |
| 5,762,516 A | * | 6/1998 | Itoga et al. | 439/404 |
| 6,045,391 A | * | 4/2000 | Jaag | 430/405 |
| 6,050,842 A | | 4/2000 | Ferrill et al. | 439/404 |
| 6,050,843 A | | 4/2000 | Adriaenssens et al. | 439/404 |
| 6,220,896 B1 | | 4/2001 | Bertoncini et al. | 439/608 |
| 6,346,005 B1 | * | 2/2002 | Viklund et al. | 439/404 |
| 6,582,247 B2 | * | 6/2003 | Siemon | 439/405 |

* cited by examiner

*Primary Examiner*—Tho D. Ta

(57) ABSTRACT

A connector assembly is provided including a housing having a top end and a bottom end with contact channels extending through the housing. The connector assembly also includes contacts provided in the contact channels that are arranged in differential pairs and an electrically common shield having dividers mounted in the housing to separate adjacent differential pairs of the contacts. The electrically common shield is isolated from ground.

26 Claims, 9 Drawing Sheets

CONNECTOR ASSEMBLY WITH A FLOATING SHIELD DIVIDING CONTACTS FORMED IN DIFFERENTIAL PAIRS

BACKGROUND OF THE INVENTION

Certain embodiments of the present invention generally relate to connectors that electrically connect components to one another and more particularly relate to an electrical connector assembly having contacts arranged in differential pairs.

Various electronic systems, such as those used to transmit signals in the telecommunications industry, include connector assemblies that electrically connect differential pairs of electrical wires with each other or differential pairs of electrical wires to electrical plugs. The telecommunications industry uses an unshielded twisted pair (UTP) system where one wire in the differential pair carries a positive signal and the other wire carries a negative signal. The differential pair does not include a ground, but instead carries signals intended to have the same absolute magnitude. The connector assemblies include insulated housings having contact channels that hold contacts (e.g., insulation displacement contacts (IDCs)). The IDCs have top and bottom ends configured to pierce insulation that surrounds wires inserted into the IDCs in order that the IDCs electrically engage corresponding conductive wires. The contact channels in the housing are arranged such that IDCs are maintained within the housing in differential pairs. One IDC in each differential pair connects two wires that carry positive signals. The other IDC in each differential pair connects two wires that carry negative signals.

However, conventional connector assemblies have several drawbacks. First, the IDCs of different differential pairs are positioned proximate each other such that unwanted electromagnetic (EM) signal coupling, or cross talk, develops between the IDCs of differential pairs of IDCs. The cross talk degrades the quality of the signal transmissions such that the electrical signals may not be deciphered at their destination. Some connector assemblies have been proposed that afford EM shielding by providing metal shields between the differential pairs of IDCs. The shields act as barriers to electrically isolate the differential pairs of IDCs and prevent unwanted EM signal coupling between IDCs of adjacent differential pairs. The EM signals cause the shields to collect a capacitive charge. Conventional connector assemblies discharge the capacitive charge by connecting the shields to ground.

Further, because the IDCs in a differential pair have different geometries from the wires in a differential pair, the electrical signals experience a different impedance when traveling through the differential pairs of IDCs than when traveling through the differential pairs of wires. This mismatched impedance causes a portion of the electrical signals to be reflected back toward its source. The amount of reflection that occurs due to a change in impedance is considered a return loss.

In certain industries, standards are set for performance requirements of electrical connector assemblies, including a bandwidth for the transmission of signals. New standards have increased the maximum frequency of the bandwidth such that many conventional connector assemblies exhibit too much cross talk and return loss to meet the more stringent frequency requirements.

Thus, a need exists for a connector assembly that reduces cross talk and return loss in a connector assembly holding multiple differential pairs of IDCs.

BRIEF SUMMARY OF THE INVENTION

Certain embodiments provide a connector assembly including a housing having a top end and a bottom end with contact channels extending through the housing. The connector assembly also includes contacts provided in the contact channels that are arranged in differential pairs. The connector assembly includes an electrically common shield having dividers mounted in the housing to separate adjacent differential pairs of the contacts. The electrically common shield is isolated from ground.

Optionally, a plurality of planar divider shields are arranged in an interleaved manner between the differential pairs of contacts. First and second contacts within a differential pair introduce positive and negative charges onto first and second divider shields, respectively. The positive and negative charges introduced onto the first and second divider shields substantially negate one another to form a substantially zero net charge.

Figure 1:
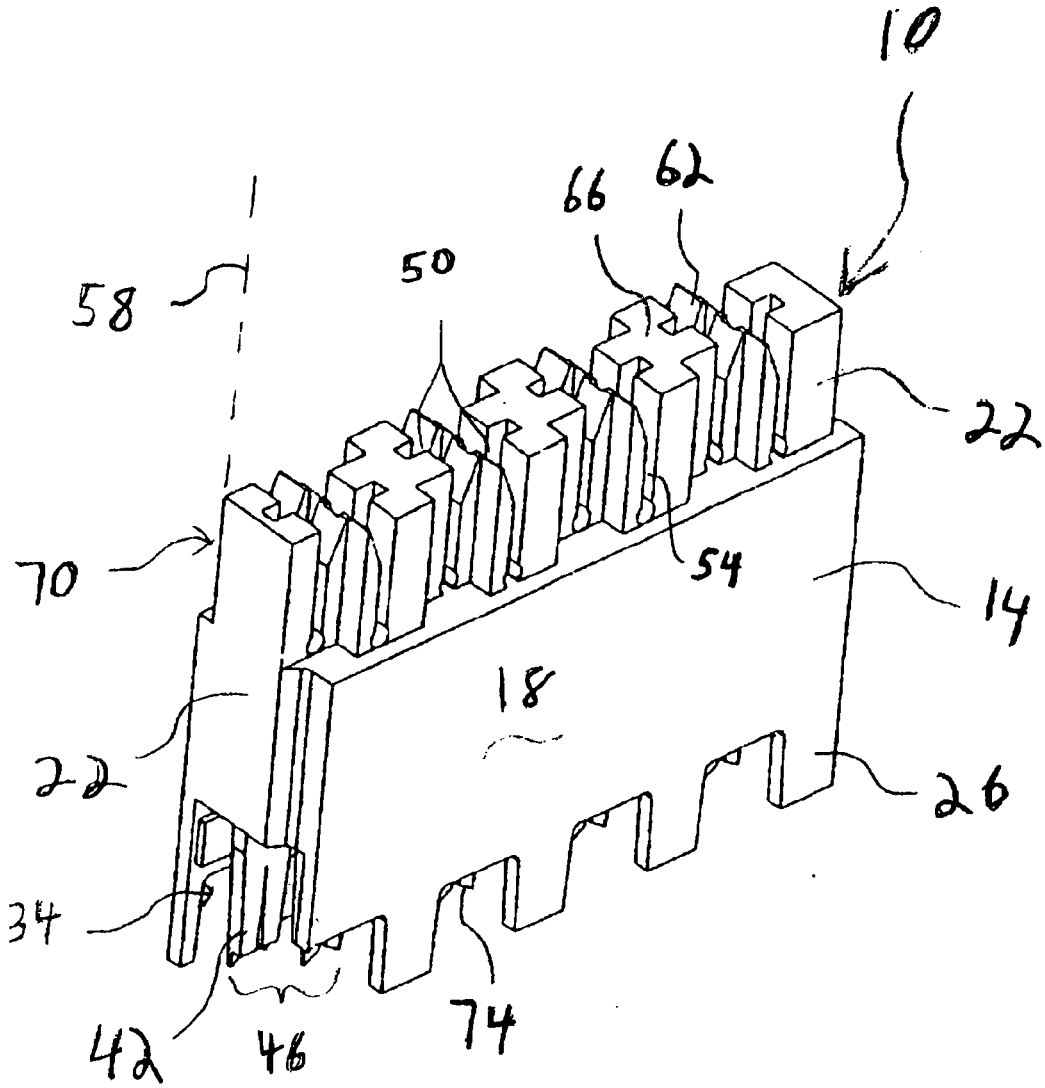
FIG. 1 illustrates an isometric view of a connector assembly formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of a connector assembly 10 formed according to an embodiment of the present invention. The connector assembly 10 is configured to connect to one another incoming and outgoing insulated wires (not shown) which are arranged in differential pairs, such as used in the operation systems of the telecommunications industry for data, voice, or power transmission. By way of example only, one wire in each differential pair carries a positive signal and the other wire in each differential pair carries a negative signal. The positive and negative signals are intended to have the same absolute magnitude.

A housing 14 includes posts 22 that extend upward near a top end 70. The posts 22 are located proximate opposite ends of the housing 14. A series of interleaved tapered insulators 62 and block insulators 66 also extend upward at the top end 70. The tapered and block insulators 62 and 66 are separated by contact channels 50 that extend through the housing 14 parallel to a vertical axis 58. The housing 14 holds contacts (insulation displacement contacts (IDCs) 42 in this embodiment) arranged in differential pairs 46 within the contact channels 50. The IDCs 42 extend through the housing 14 parallel to the vertical axis 58, and have bottom portions 74 that extend out of a bottom end of the contact channels 50 proximate a bottom end 34 of the housing 14. Wire retention slot 54 are cut between the tapered insulators 62 and block insulators 66 and between the tapered insulators 62 and posts 22 at the top, end 70 of the housing 14. Each wire retention slot 54 intersects a corresponding contact channel 50. The wire retention slots 54 extend between side walls 18 of the housing 14 in a direction transverse to the contact channels 50 and vertical axis 58.

The connector assembly 10 receives a first group of wires in the top end 70 and a second group of wires in the bottom end 34. The first group of wires are arranged in differential pairs and the second group of wires are arranged in differential pairs. The wires in the differential pairs of the first group are inserted into corresponding wire retention slots 54 to engage corresponding IDCs 42 proximate the top end 70. Similarly, the wires in the differential pairs of the second group engage corresponding IDCs 42 at the bottom portion 74.

Figure 2:
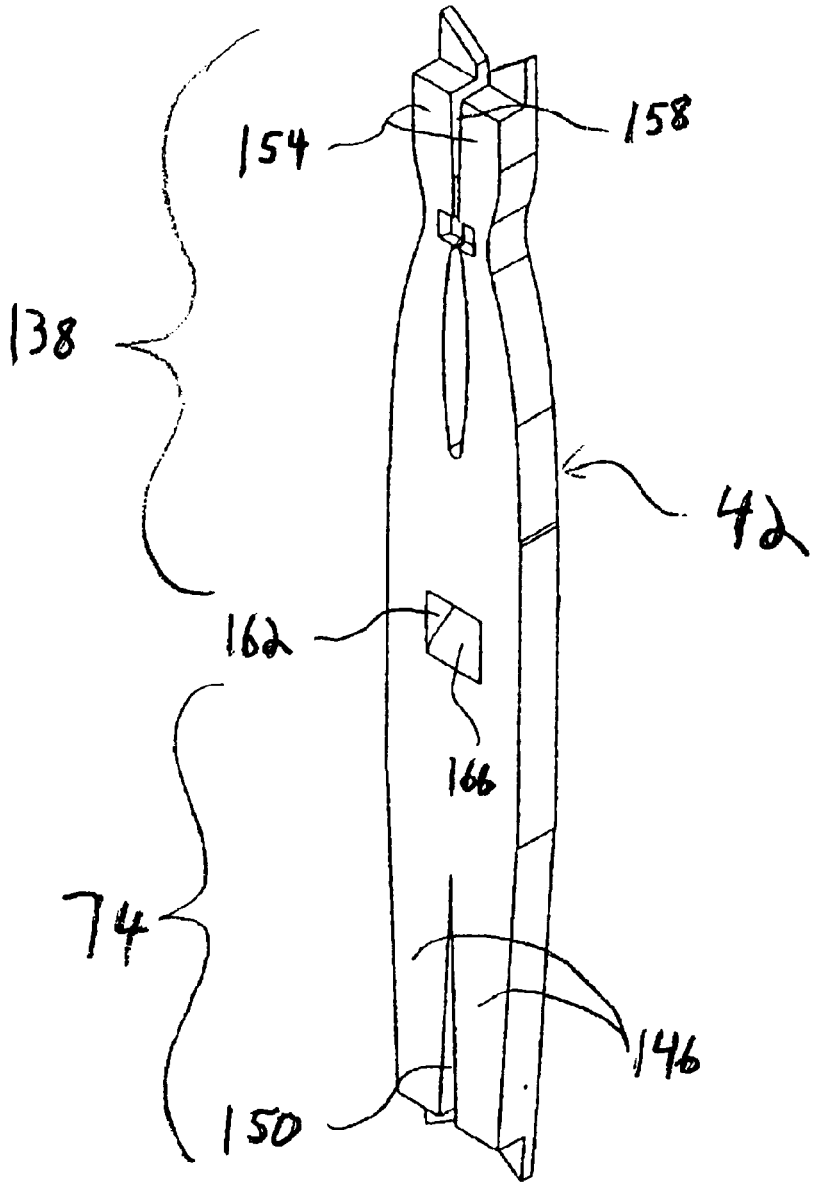
FIG. 2 illustrates an isometric view of an IDC formed according to an embodiment of the present invention.

FIG. 2 illustrates an isometric view of an IDC 42 formed according to an embodiment of the present invention. The IDC 42 is formed from a thin piece of metal having a top portion 138 and the bottom portion 74. Two catch legs 146 extend from the bottom portion 74 to define a V-shaped wire catch 150 therebetween that receives a corresponding wire. As shown in FIG. 1, the bottom portion 74 extends from the bottom end 34 of the housing 14. Returning to FIG. 2, two catch legs 154 also extend from the top portion 138 to define a smaller V-shaped wire catch 158 that also receives a corresponding wire. The IDCs 42 are retained within the housing 14 (FIG. 1) such that the top portion 138 is positioned within the wire retention slot 54 (FIG. 1) to receive a wire in the wire catch 158.

The wires are pushed into the wire catches 150 and 158 until the catch legs 146 and 154, respectively, cut through insulation covering of the wires to electrically engage the wires. The IDC 42 also includes a square shaped aperture 162 formed therein, with a latch 166 extending from a backside of the IDC 42. With reference to FIG. 1, the IDCs 42 are inserted into the contact channels 50 from the bottom end 34 of the housing 14 until the latch 166 engages a ledge formed on the interior of the contact channel 50 and the aperture 162 receives a protrusion also formed on the intrusion of the contact channels 50. The latch 166 and aperture 162 thus resistibly retains the IDC 42 within the housing 14.

Figure 3:
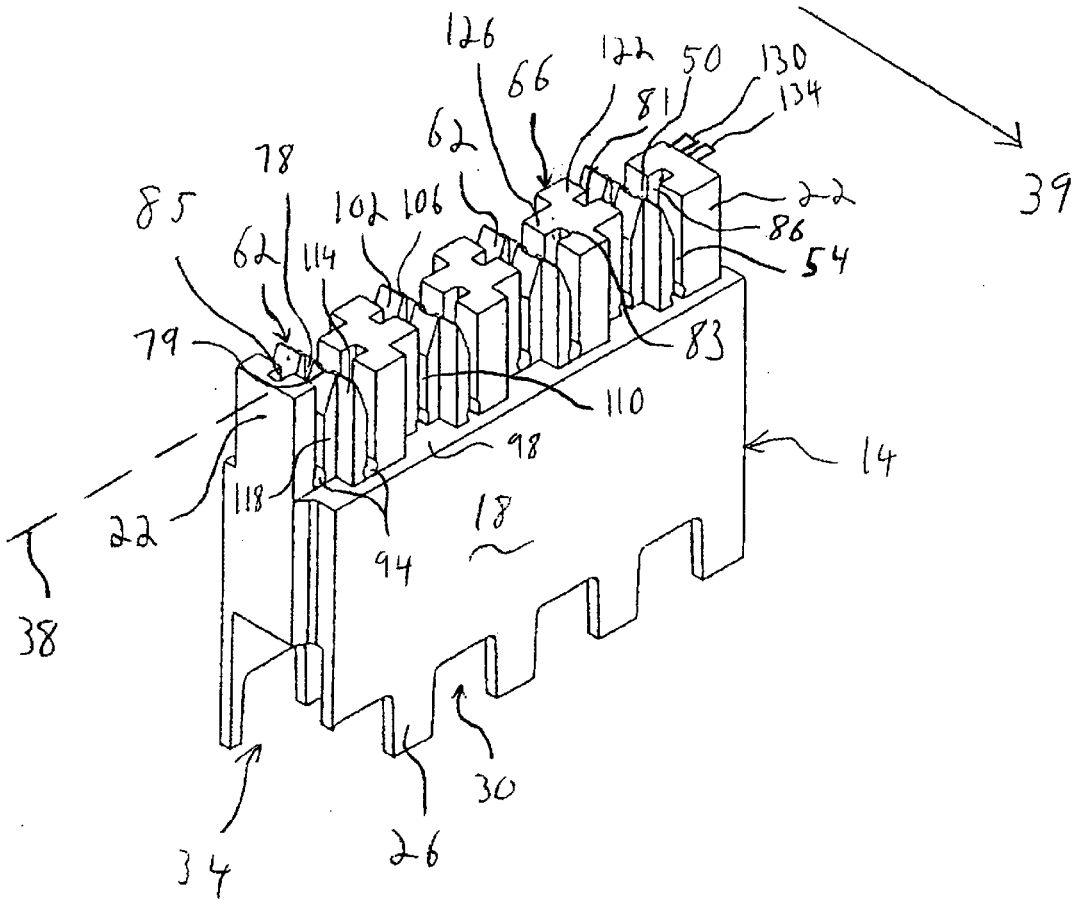
FIG. 3 illustrates an isometric view of an insulated housing formed according to an embodiment of the present invention.

FIG. 3 illustrates an isometric view of the housing 14 formed according to an embodiment of the present invention. The side walls 18 include rectangular legs 26 arranged along the bottom end 34 and separated by gaps 30. The wires extend from the housing 14 at the bottom end 34 through the gaps 30 between the legs 26. The tapered insulators 62, block insulators 66, and posts 22 include curved gaps 94 at the base of the wire retention slots 54 proximate a top surface 98 of the side walls 18. In operation, the wires are slid downward along the wire retention slots 54 and into the curved gaps 94. The curved gaps 94 securely retain the wire between the tapered insulators 62, the block insulators 66, and the posts 22, and within the wire catches 158 (FIG. 2) of the IDCs 42 (FIG. 2).

The block insulators 66 and tapered insulators 62 are alternately positioned between the posts 22 and are separated by the contact channels 50. The tapered insulators 62 have tapered top walls 102 that extend downward from a peak 106 at an angle until joining the side walls 110. The tapered insulators 62 have first and second portions 114 and 118 that are offset from each other in a transverse direction 39 relative to a longitudinal axis 38 extending through a central plane of the housing 14. The first and second portions 114 and 118 include recesses 79 and 78, respectively, formed in opposite sides of the tapered insulator 62. The recesses 78 and 79 are offset from each other along either side of the longitudinal axis 38. The block insulators 66 have C-shaped first and second portions 122 and 126 facing in opposite directions that are offset from each other in the transverse direction 39 relative to the longitudinal axis 38. The first and second portions 122 and 126 include recesses 81 and 83, respectively, facing in opposite directions. The recesses 81 and 83 are shifted transversely to be located on opposite sides of the longitudinal axis 38. The recesses 81 are aligned with the recesses 78 in the second portions 118 of the tapered insulators 62. Likewise, the recesses 83 are aligned with the recesses 79 of the first portions 114 of the tapered insulators 62. The recesses 78 and 81 define a first group of contact channels 50 arranged in line with one another in a first row 130 and spaced on one side of the longitudinal axis 38. The recesses 79 and 83 define a second group of contact channels 50 arranged in line with one another in a second row 134 and spaced on another side of the longitudinal axis 38.

The posts 22 are also offset from each other in the transverse direction 39 on either side of the longitudinal axis 38. The posts 22 include recesses 85 and 86 that are aligned with corresponding recesses 78 and 79 of the tapered insulator 62. The recess 85 is in the first row 130 and the recess 86 is in the second row 134.

Figure 4:
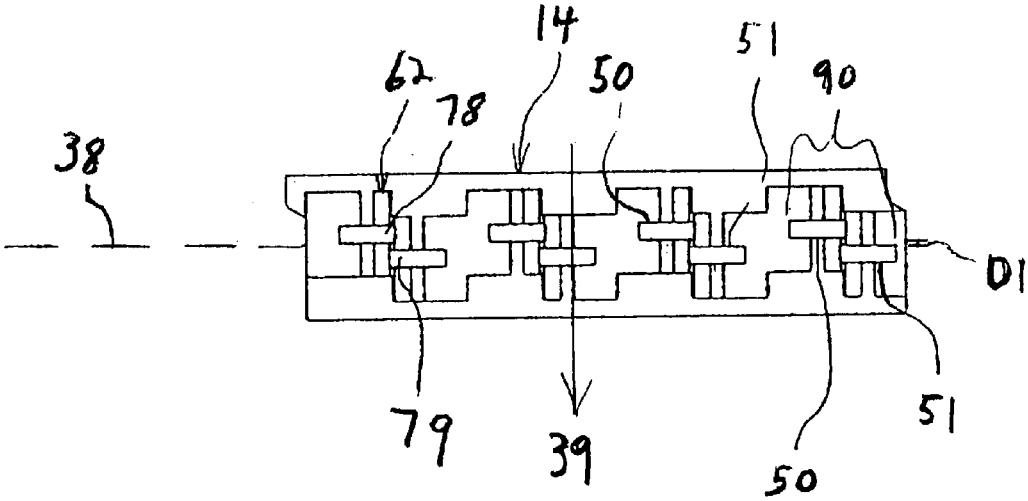
FIG. 4 illustrates a top plan view of the insulated housing of FIG. 3.

FIG. 4 illustrates a top plan view of the housing 14 of FIG. 3. The recesses 78 and 79 are notched sufficiently deep, in each tapered insulator 62, to overlap in the direction transverse to the longitudinal axis 38 in order that adjacent contact channels 50 and 51 overlap in the transverse direction 39. The overlapping contact channels 50 and 51 form a differential pair 90. The contact channels 50 and 51 of a differential pair 90 are separated from each other by a channel-to-channel distance of D1.

Figure 5:
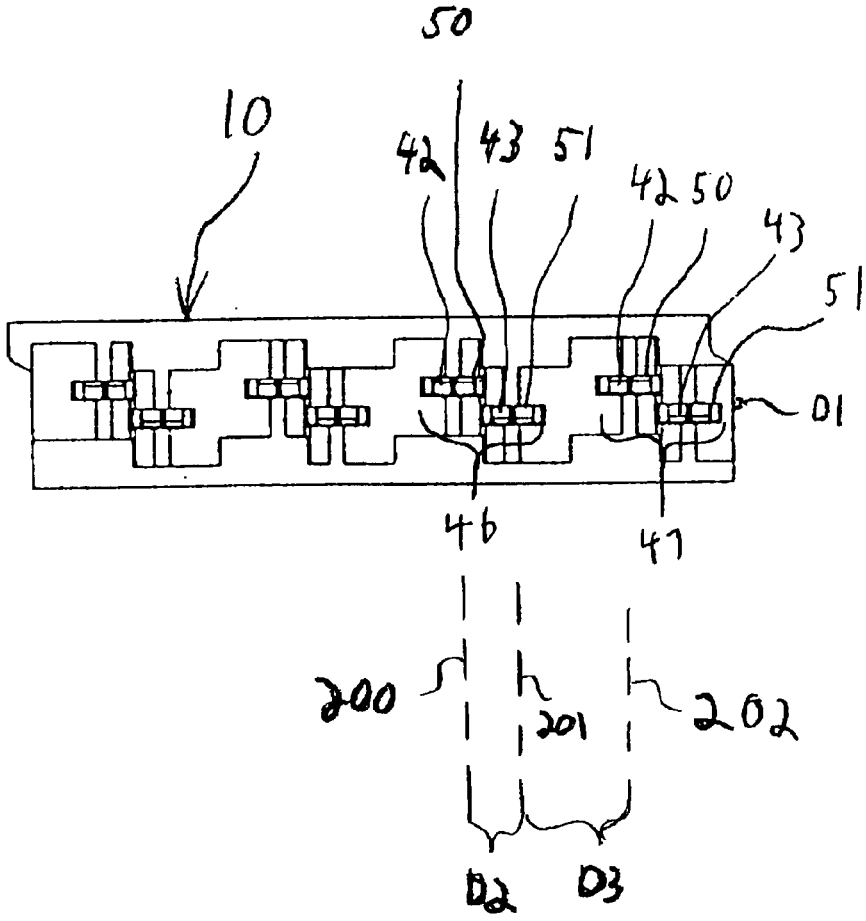
FIG. 5 illustrates a top plan view of the connector assembly of FIG. 1.

FIG. 5 illustrates a top plan view of the connector assembly 10 of FIG. 1 with IDCs 42 and 43 retained within the contact channels 50 and 51, respectively, arranged in IDC differential pairs 46 and 47. The IDCs 42 and 43 in each IDC differential pair 46 and 47 are separated from each other by the distance D1. IDCs 42 and 43 of the differential pair 46 have centerlines 200 and 201, respectively, separated by a distance D2. The IDC 43 in the differential pair 47 has a centerline 202 that is separated from the centerline 201 by a distance D3. D3 is greater than D2. Because the distance D3 is greater than the distance D2, the IDCs 42 and 43 within the differential pair 46 are more closely EM coupled to one another than to the IDCs 42 and 43 of the differential pair 47. Thus cross talk is reduced between the IDCs 42 and 43 of the adjacent IDC differential pairs 46 and 47. The distance D1 maintains the IDCs 42 and 43 of the differential pairs 46 and 47 at a proximity such that the electrical signals experience a relatively uniform impedance (for example, 100 Ohm) when passing between the wires through the IDCs 42 and 43. Therefore, the close transverse overlapping alignment of the IDCs 42 and 43 within the IDC differential pairs 46 and 47 reduces return loss.

Figure 6:
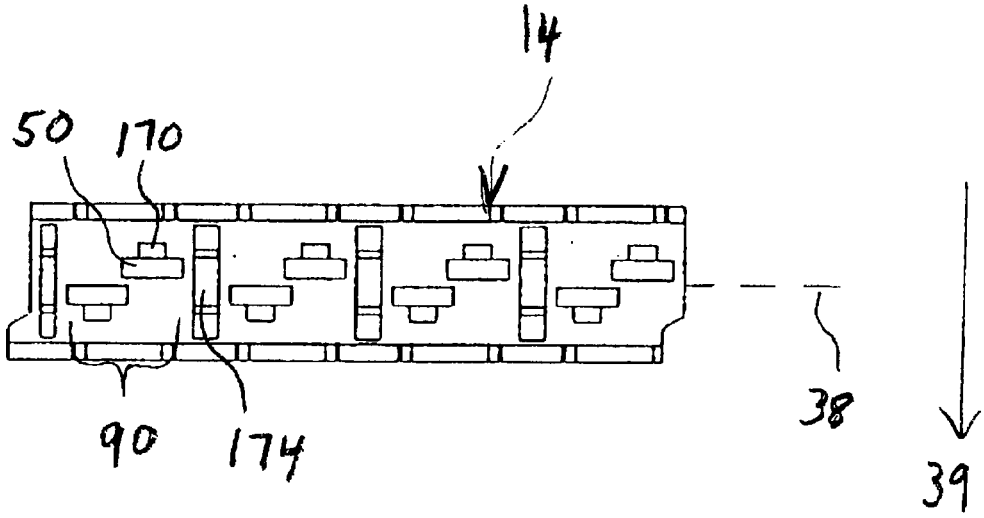
FIG. 6 illustrates a bottom view of the insulated housing of FIG. 3.

FIG. 6 illustrates a bottom view of the housing 14 without the IDCs 42 (FIG. 2) inserted. Catch slots 170 are formed in sides of the contact channels 50. The catch slots 170 receive the catches 166 (FIG. 2) of the IDCs 42 as the IDCs 42 are inserted into the housing 14. Divider slots 174 are also formed in the housing 14 between each differential pair 90 of contact channels 50 and extend in the transverse direction 39 relative to the longitudinal axis 38. The divider slots 174 receive divider shields 182 (FIG. 7) that are inserted into the housing 14 to reduce the cross talk between the differential pairs 46 and 47 (FIG. 5) of IDCs 42.

Figure 7:
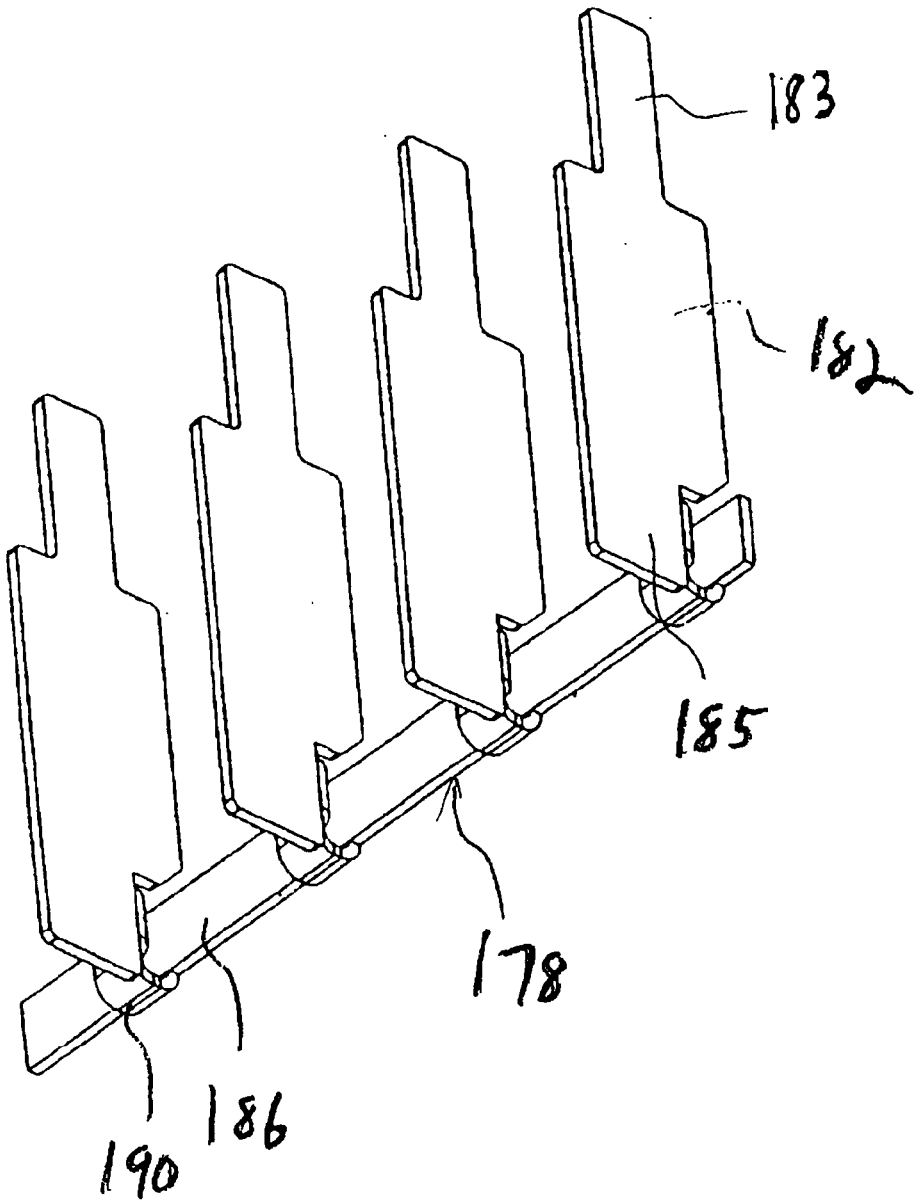
FIG. 7 illustrates an isometric view of an electrically common shield formed according to an embodiment of the present invention.

FIG. 7 illustrates an isometric view of an electrically common shield 178 formed according to an embodiment of the present invention. The electrically common shield 178 is stamped and formed from a single metal piece on the EM shielding material. The electrically common shield 178 includes a plurality of conductive, non-grounded divider shields 182 that are joined via hooks 190 to a bridging shield 186. The divider shields 182 are thin and planar and aligned in planes that are oriented parallel to one another. The divider shields 182 are inserted into the divider slots 174 (FIG. 6) of the housing 14 (FIG. 6) in an interleaved manner between the IDC differential pairs 46 (FIG. 5). When the divider shields 182 are inserted into the divider slots 174, the bridging shield 186 and hooks 190 are located proximate the bottom end 34 (FIG. 1) of the housing 14 between the legs 26. The divider shields 182 may take many shapes. By way of example, only the divider shields 182 include a neck portion 183 at one end and a base portion 185 at an opposite end. The base portions 185 join the hooks 190. The neck portions 183 extend into the posts 22 (FIG. 1) and block insulators 66 (FIG. 1) at the top end 70 (FIG. 1) in order to be located between the top portions 138 (FIG. 2) of the IDCs 42 in adjacent IDC differential pairs 46.

Figure 8:
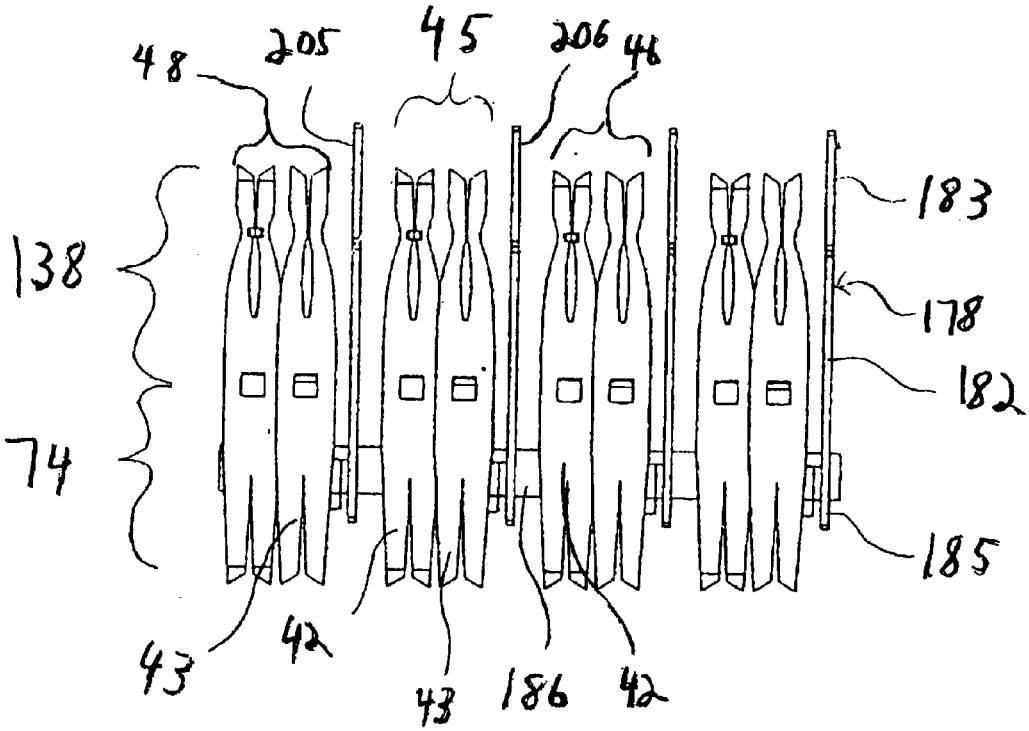
FIG. 8 illustrates a front view of an electrically common shield with interleaved differential pairs of IDCs formed according to an embodiment of the present invention.

FIG. 8 illustrates a front view of the alignment between the electrically common shield 178 of FIG. 7 and IDC differential pairs 45, 46, and 48 with the housing 14 (FIG. 3) removed. In operation, when the divider shields 182 and the IDCs 42 and 43 are in the housing 14, the divider shields 182 act as barriers separating the IDC differential pairs 45, 46, and 48 to prevent cross talk and interference between adjacent IDC differential pairs 45 and 46 and adjacent IDC differential pairs 45 and 48.

As electrical signals travel between the wires through the IDCs 42 and 43, the electrical signals create local EM fields that induce a capacitive charge onto the divider shields 182 located proximate to the IDCs 42 and 43. For example, the IDC 42 of the differential pair 45 carries a negative signal which creates a negative charge on a divider shield 205, and the IDC 43 of the differential pair 45 carries a positive signal which creates a positive charge on a divider shield 206. Because the divider shields 205 and 206 are interconnected with one another through the bridging shield 186, the charges collected, negative and positive, separately on the divider shields 205 and 206, respectively, negate each other to result in a substantially zero net charge. The electrically common shield 178 and divider shields 182 are not connected to ground or any other fixed charge potential. If the divider shields 205 and 206 were not connected by the bridging shield 186, the divider shield 205 would distribute some of the negative charge to the IDC 43 of the proximate differential pair 48, and the divider shield 206 would distribute some of the positive charge to the IDC 42 of differential pair 46, thus creating cross talk. Therefore, the electrically common shield 178 improves electrical transmission. The cross talk and noise at the higher frequencies is reduced to a level that makes transmission possible.

In the embodiment shown in FIG. 8, there are four differential pairs 46 of IDCs 42 and four dividers shields 182 arranged such that the differential pair 48 is not positioned between two divider shields 182, rather the differential pair 48 is only proximate the divider shield 205. Therefore, only the divider shield 205 is charged by the differential pair 48, and the charge is not negated by another charge of a similar magnitude. Thus, the common shield 178 may have a net positive or negative charge depending on the charge that is placed on the divider shield 205 by the differential pair 48. However, a fifth divider shield 182 may be added such that all the differential pairs 46 of IDCs 42 are between divider shields 182. Thus, all the charges negate each other and the common shield 178 has a substantially zero net charge.

Figure 9:
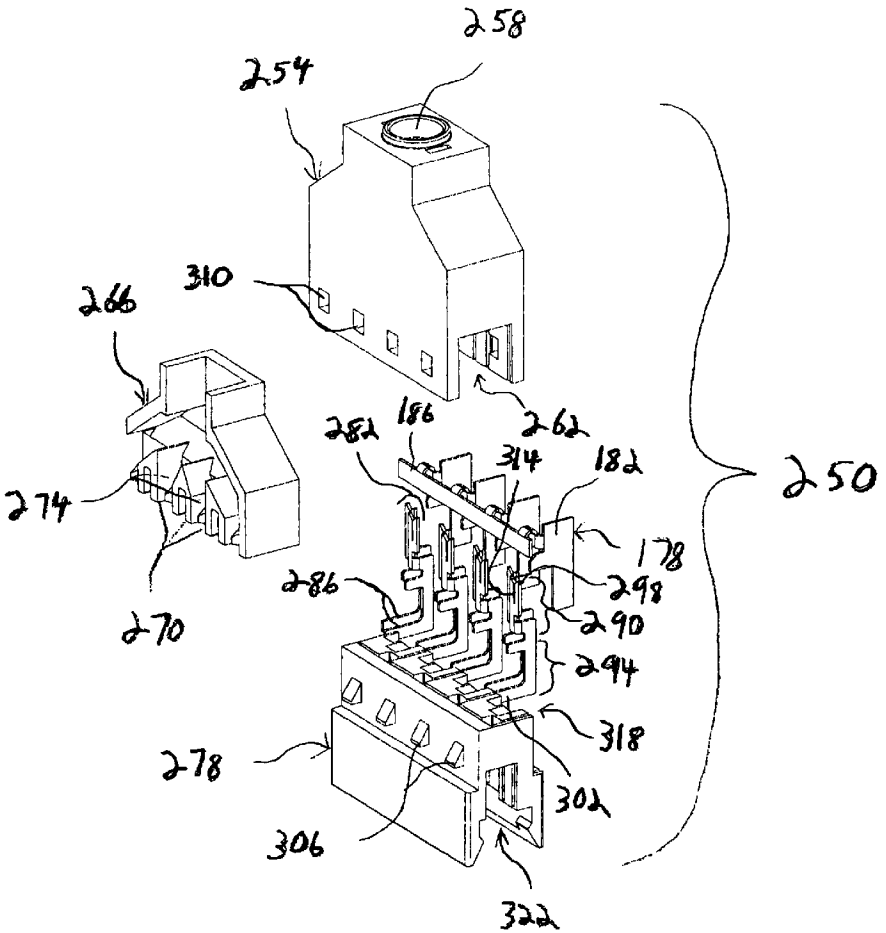
FIG. 9 illustrates an exploded view of an electrical plug formed in accordance with an alternative embodiment of the present invention.

FIG. 9 illustrates an exploded view of an electrical plug 250 formed in accordance with an alternative embodiment of the present invention. The electrical plug 250 includes a cover 254 having an aperture 258 at one end and an opening 262 at an opposite end. Differential pairs of wires (not shown) retained in a jacket are received into the cover 254 through the aperture 258. The opening 262 receives a lacing insert 266 that has dividers 270 defining channels 274. When the wires are inserted into the aperture 258, the differential pairs of wires are separated from each other into the channels 274 by the dividers 270.

The electrical plug 250 also includes a housing 278 that receives and retains differential pairs 282 of plug contacts 286 and the electrically common shield 178. The housing 278 has latches 306 that are received within catches 310 in the cover 254 in order to snapably connect the cover 254 and the housing 278. The contacts 286 are retained within the housing 278 such that top portions 290 of the contacts 286 extend along a top end 318 of the housing 278 and bottom portions 294 of the contacts 286 are retained within a bottom gap 322 of the housing 278. As in the previous embodiment, the divider shields 182 separate the differential pairs 282 of contacts 286 and are electrically connected by a bridging shield 186 to reduce cross talk. The contacts 286 have two catch legs 298 extending from the top portion 290 and a mating foot 302 extending from the bottom portion 294. The catch legs 298 define a wire catch 314.

In operation, when the cover 254 retains the wires and the lacing insert 266 such that the differential pairs of wires are separated within the channels 274, the cover is snapably connected to the housing 278, which retains the contacts 286 and electrically common shield 178. When the housing 278 and the cover 254 are connected, the wires in each differential pair of wires are inserted into corresponding wire catches 314 of a differential pair 282 of contacts 286. The wires thus become electrically connected to the contacts 286. The electrical plug 250 is then attached to the connector assembly 10 (FIG. 1) at the top end 70 (FIG. 1). The mating feet 302 of the contacts 286 are received in the wire catches 158 (FIG. 2) of corresponding IDCs 42 (FIG. 2) within the connector assembly 10, and the contacts 286 of the electrical plug 250 are electrically connected to the IDCs 42 of the connector assembly 10. Thus, the electrically common shield 178 is used to reduce cross talk in wire-to-wire connectors and wire-to-plug connectors.

The connector assemblies of the various embodiments confer several benefits. First, overlapping IDCs in any one differential pair of IDCs in parallel rows reduces the distance between the IDCs of a single differential pair and increases the distance between IDCs of adjacent differential pairs. This overlapping alignment increases EM coupling between the IDCs in any one differential pair and reduces cross talk between IDCs of adjacent differential pairs. The overlapping alignment also brings IDCs in a differential pair closer together such that the impedance experienced by the electrical signals passing through the IDCs is matched to the 100 Ohms of the wires, thus reducing reflection of electrical signals that pass through the IDCs. Secondly, separating the differential pairs of IDCs by an electrically common shield reduces cross talk between the differential pairs of IDCs.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector assembly comprising:

a housing having a top end and a bottom end with contact channels extending through said housing, said contact channels extending in said housing in at least two parallel rows along a longitudinal axis of said housing in a staggered, overlapping manner;

contacts provided in said contact channels, said contacts being arranged in differential pairs in said contact channels, each of said contacts of each differential pair extending in a respective one of said parallel rows of contact channels; and an electrically common shield having dividers mounted in said housing to separate adjacent differential pairs of said contacts, said electrically common shield being isolated from ground.

2. The connector assembly of claim 1, wherein first and second rows of said contacts are located on opposite sides of a longitudinal axis and staggered with respect to one another.

3. The connector assembly of claim 1, wherein said contacts constitute insulation displacement contacts (IDCs) and wherein first and second IDCs are positioned to overlap one another in a transverse direction perpendicular to longitudinal and vertical axes of said housing.

4. The connector assembly of claim 1, wherein said contacts constitute insulation displacement contacts (IDCs) having a generally planar structure with wire catches formed on opposite ends thereof, said IDCs being oriented in a plane parallel to a longitudinal axis of said housing.

5. The connector assembly of claim 1, wherein said housing includes alternate tapered insulators and block insulators projecting from said housing proximate said top end, and wherein adjacent tapered and block insulators define said contact channels.

6. The connector assembly of claim 1, wherein said dividers include a plurality of planar divider shields aligned in separate planes oriented parallel to one another.

7. The connector assembly of claim 1, wherein said dividers include a plurality of planar divider shields arranged in an interleaved manner between said differential pairs of contacts.

8. The connector assembly of claim 1, wherein said dividers include first and second divider shields located on opposite sides of a first differential pair of contacts, wherein first and second contacts within said first differential pair introduce positive and negative charges onto said first and second divider shields, respectively, said positive and negative charges introduced onto said first and second divider shields substantially negating one another to form a substantially zero net charge introduced by said first differential pair.

9. The connector assembly of claim 1, wherein said dividers include divider shields mounted on opposite sides of at least one differential pair of contacts, said divider shields experiencing opposite charges of substantially equal magnitude induced by said one differential pair of contacts resulting in a substantially zero net charge on said electrically common shield introduced by said one differential pair.

10. The connector assembly of claim 1, wherein said housing receives an electrical plug carrying a set of plug contacts, said plug contacts being arranged in differential pairs separated by a second electrically common shield that is isolated from ground, said contacts and plug contacts being electrically connected.

11. A connector assembly comprising:

a housing having a top end and a bottom end, and alternate tapered insulators and block insulators projecting from said housing proximate said top end, said tapered and block insulators defining contact channels extending through said housing between said top and bottom ends along a vertical axis of said housing, said contact channels being positioned adjacent to one another and aligned in at least two parallel rows extending along a longitudinal axis of said housing, said contact channels being located in at least two parallel rows along said longitudinal axis in a staggered, overlapping pattern;

contacts provided within said contact channels, said contacts being arranged in differential pairs along said at least two parallel rows; and an electrically common shield having divider shields mounted in said housing between said differential pairs of contacts said divider shields being interconnected with one another.

12. The connector assembly of claim 11, wherein said electrically common shield is isolated from ground.

13. The connector assembly of claim 11, wherein said electrically common shield is permitted to exhibit a floating charge that fluctuates from ground potential.

14. The connector assembly of claim 11, wherein first and second rows of said contacts are located on opposite sides of said longitudinal axis and staggered with respect to one another.

15. The connector assembly of claim 11, wherein said contacts constitute insulation displacement contacts (IDCs) and wherein first and second IDCs are positioned to overlap one another in a transverse direction perpendicular to said longitudinal and vertical axes of said housing.

16. The connector assembly of claim 11, wherein said contacts constitute insulation displacement contacts (IDCs) having a generally planar structure with wire catches formed on opposite ends thereof, said IDCs being oriented in a plane parallel to said longitudinal axis of said housing.

17. The connector assembly of claim 11, wherein said divider shields are aligned in separate planes oriented parallel to one another.

18. The connector assembly of claim 11, wherein first and second divider shields are located on opposite sides of a first differential pair of contacts, wherein first and second contacts within said first differential pair introduce positive and negative charges onto said first and second divider shields, respectively, said positive and negative charges introduced onto said first and second divider shields substantially negating one another to form a substantially zero net charge introduced by said first differential pair.

19. The connector assembly of claim 11, wherein said housing receives an electrical plug carrying a set of plug contacts, said plug contacts being arranged in differential pairs separated by a second electrically common shield that is isolated from ground, said contacts and plug contacts being electrically connected.

20. A connector assembly comprising:

a housing having a top end and a bottom end with contact channels extending through said housing;

insulation displacement contacts (IDCs) provided in said contact channels, said IDCs being arranged in differential pairs; said contact channels arrange said IDCs in at least two parallel rows along a longitudinal axis of said housing in a staggered, overlapping manner; and an electrically common shield having dividers mounted in said housing to separate adjacent differential pairs of said IDCs, said electrically common shield being isolated from ground.

21. The connector assembly of claim 20, wherein first and second rows of said IDCs are located on opposite sides of a longitudinal axis and staggered with respect to one another.

22. The connector assembly of claim 20, wherein first and second IDCs are positioned to overlap one another in a transverse direction perpendicular to longitudinal and vertical axes of said housing.

23. The connector assembly of claim 20, wherein said IDCs have a generally planar structure with wire catches formed on opposite ends thereof, said IDCs being oriented in a plane parallel to a longitudinal axis of said housing.

24. The connector assembly of claim 20, wherein said housing includes alternate tapered insulators and block insulators projecting from said housing proximate said top end, and wherein adjacent tapered and block insulators define said contact channels.

25. The connector assembly of claim 20, wherein said dividers include a plurality of planar divider shields aligned in separate planes oriented parallel to one another.

26. The connector assembly of claim 20, wherein said dividers include a plurality of planar divider shields arranged in an interleaved manner between said differential pairs of IDCs.

* * * * *